US006029630A

United States Patent [19]

Toyohara et al.

[11] Patent Number: 6,029,630

[45] Date of Patent: Feb. 29, 2000

[54] ENGINE CONTROL DEVICE HAVING AN ARRANGEMENT FOR LIMITING INTERRUPT PROCESSING

[75] Inventors: Masahiro Toyohara, Hitachiohta; Takeshi Atago; Katsuya Oyama, both of Hitachinaka, all of Japan

[73] Assignees: Hitachi, Ltd.; Hitachi Car Engineering Co., Ltd., both of Japan

[21] Appl. No.: 09/098,001

[22] Filed: Jun. 16, 1998

[30] Foreign Application Priority Data

Jun. 16, 1997 [JP] Japan ..... 9-158808

[51] Int. Cl.[7] ..... F02M 51/00

[52] U.S. Cl. ..... 123/480; 123/406.58; 123/486; 701/104

[58] Field of Search ..... 123/480, 406.12, 123/406.58, 478, 486; 701/104, 102

[56] References Cited

U.S. PATENT DOCUMENTS

| | | | |
|---|---|---|---|
| 5,025,380 | 6/1991 | Wataya et al. | 123/104 |
| 5,126,944 | 6/1992 | Sakuma et al. | 123/480 |
| 5,497,329 | 3/1996 | Tang | 123/480 |
| 5,522,365 | 6/1996 | Milunas et al. | 123/480 |
| 5,628,292 | 5/1997 | Guido et al. | 123/406.58 |
| 5,781,875 | 7/1998 | Maki et al. | 123/104 |
| 5,806,012 | 9/1998 | Maki et al. | 123/480 |
| 5,823,166 | 10/1998 | Entenmann et al. | 123/406.58 |
| 5,896,845 | 4/1999 | Matsuda et al. | 123/480 |

*Primary Examiner*—John Kwon
*Attorney, Agent, or Firm*—Evenson, McKeown, Edwards & Lenahan, P.L.L.C.

[57] ABSTRACT

An engine control device comprising has a processor which receives a variety of operating state detection signals (such as an engine crank angle signal and an accelerator opening signal) and computes control quantities for an interrupt routine on the basis of a predetermined signal such as the engine crank angle signal or a signal generated at fixed basic intervals, in accordance with a predetermined program during a period of time between the predetermined signals. A means is provided for counting and/or limiting the number of times interrupt processing triggered by an activation signal for the routine is executed during the period of time between the predetermined signals whenever processing of the routine exists.

9 Claims, 13 Drawing Sheets

ENGINE CONTROL DEVICE HAVING AN ARRANGEMENT FOR LIMITING INTERRUPT PROCESSING

BACKGROUND OF THE INVENTION

The present invention relates to an engine control device and an engine control method thereof.

In an engine control device of an automobile, a CPU of a microcomputer carries out various kinds of control processing on fuel injection by sensing detection signals representing a variety of operating states such as the engine speed of the automobile, the accelerator opening and the air pressure inside the intake pipe. In addition, the CPU also determines the start of electrical conduction in the ignition system and ignition timing in accordance with a crank angle signal in synchronization with the rotation of the engine by invoking an interrupt routine at predetermined time intervals. That is to say, in the course of processing carried out by the CPU, interrupt processing is triggered by an interrupt. The triggering frequency of the interrupt processing can be limited or the interrupt processing itself can even be inhibited. Inventions for limiting the triggering frequency of such interrupt processing are disclosed in the following patent applications.

In Japanese Patent Laid-open No. Hei 2-86943, there is disclosed an engine control device which comprises: a first computation means for computing control data of an engine by interrupt processing synchronized with the rotation of the engine; an upper level interrupt processing means for computing parameters such as an interrupt period and an interrupt execution time in processing at a level higher than the interrupt processing; a second computation means for computing a ratio of an execution time of the interrupt processing to an interrupt period of the first computation means; and an interrupt inhibiting means for inhibiting a next interrupt of the first computation means in case the ratio computed by the second computation means exceeds a predetermined value.

In Japanese Patent Laid-open No. Hei 6-249052, there is disclosed an engine control method whereby: while processing other than interrupt processing is being carried out a predetermined number of times, a computation means 2 counts the number of times the interrupt processing synchronized with the rotation of an engine is carried out; an execution frequency determining means 3 determines an execution frequency of the interrupt processing in accordance with the number of times counted by the computation means 2; and an inhibit means 4 inhibits computation of control data by a computation means 1 activated by an interrupt when the execution frequency determining means 3 determines to inhibit the computation of control data by the computation means 1.

In addition, in Japanese Patent Laid-open No. Hei 4-228854, there is disclosed an input inhibiting means. To put it in detail, in this application, there is disclosed an ignition device for an engine which comprises: an operating state detecting means for detecting the operating state of the engine; a pulse generating means for outputting a pulse signal at a predetermined crank angle of the engine; and a control circuit which provides a driving circuit with a command signal for executing various kinds of engine control including control of an ignition system after a predetermined period of time set in accordance with the operating state of the engine has lapsed since a point of time the pulse signal generated by the pulse generating means is input, wherein the engine ignition system is provided with the input inhibiting means for inhibiting the pulse signal from being input to the control circuit during a predetermined period of time following an issuance of an ignition command signal by the control circuit.

In Japanese Patent Laid-open No. Hei 4-228854, there is disclosed the input inhibiting means for inhibiting the pulse signal from being input to the control circuit during a predetermined period of time following an issuance of an ignition command signal by the control circuit. The invention disclosed in this application relates to timing advance control. Ignition noise is generated only during a period of about 50 microseconds following the issuance of an ignition signal by a control unit. Thus, by inhibiting a crank angle signal from being supplied to the control signal only during a predetermined period of typically 100 microseconds, erroneous detection of the crank angle signal caused by ignition noise can be avoided over the entire operating range, from a low engine speed to a high engine speed, without regard to what speed the engine is rotating at.

The two other inventions each relate to an interrupt inhibiting method to inhibit processing of an interrupt which occurs after processing with a higher priority has been started.

If unnecessary processing to handle an inadvertent interrupt that occurs due to noise or a software bug is carried out, the operability and the gas exhaust performance deteriorate. Thus, it is necessary to eliminate an inadvertent interrupt that has potential as a cause of deterioration of the operatability and the gas exhaust performance.

To put it in detail, the same routine may be activated again as an inadvertent interrupt caused by noise or a software bug. Execution of such unstable interrupt control will have adversely affected the operability and the gas exhaust performance.

SUMMARY OF THE INVENTION

It is thus an object of the present invention to provide an engine control device and an engine control method that are capable of eliminating adverse effects on operability and exhaust gas performance by limiting the number of times an inadvertent interrupt is allowed to be executed.

According to the present invention, instead of indiscriminately imposing a limit on the number of times an inadvertent interrupt is allowed to be executed, an interrupt is examined and diagnosed to determine whether or not it is inadvertent.

According to inventors of the present invention, inadvertent interrupts that are attributed to noise, a clock abnormality or a software bug and may be accompanied by unnecessary processing causing deterioration of the operability and the gas exhaust performance can be classified into the following two categories:

1. Interrupts occurring in a charge combustion state

Interrupts occurring in a uniform mixture charge combustion state

Interrupts occurring in a stratified charge combustion state
2. Evaporative output comparison interrupts To put it concretely, the present invention based on the above classification provides an engine control device and an engine control method thereof described as follows.

The present invention provides an engine control device comprising: a processing means for receiving a variety of operating state detection signals such as an engine crank angle signal and an accelerator opening signal and for computing control quantities of a routine on the basis of a predetermined signal such as the engine crank angle signal or a signal generated at fixed basic intervals in accordance with a predetermined program during a period of time between the predetermined signals; and a means for limiting or counting the number of times interrupt processing triggered by an activation signal for the routine is executed during the period of time between the predetermined signals on condition that processing of the routine exists.

In addition, the present invention provides an engine control device comprising: a processing means for receiving a variety of operating state detection signals such as an engine crank angle signal and an accelerator opening signal and for determining fuel injection timing on the basis of the engine crank angle signal in accordance with a predetermined program during a period of time between the engine crank angle signals; and a means for limiting the number of times interrupt processing triggered by another activation signal for fuel injection timing is executed during the period of time between the predetermined crank angle signals to zero on condition that at least processing to determine the fuel injection timing exists in the period of time between the predetermined crank angle signals.

Furthermore, the present invention provides an engine control device characterized in that: a variety of operating state detection signals such as an engine crank angle signal and an accelerator opening signal are supplied to a processing means; a fuel injection operation is determined by the processing means on the basis of the engine crank angle signal in accordance with a predetermined program during a period of time between the engine crank angle signals; and the number of times interrupt processing triggered by another activation signal for the fuel injection operation is executed during the period of time between the predetermined crank angle signals in a lean burn operation is limited or counted on condition that at least the fuel injection operation exists in the period of time between the predetermined crank angle signals.

Further, the present invention provides an engine control device characterized in that: a variety of operating state detection signals such as an engine crank angle signal and an accelerator opening signal are supplied to a processing means; an evaporative purge valve operation is determined by the processing means on the basis of a clock timer signal in accordance with a predetermined program; and the number of times interrupt processing triggered by another activation signal for the evaporative purge valve operation is executed while a clock timer is counting is limited or counted on condition that at least the evaporative purge valve operation exists and the fact that contents of the clock timer have not reached a value for the evaporative purge valve operation.

In addition, the present invention provides an engine control device comprising: a processing means for receiving a variety of operating state detection signals such as an engine crank angle signal and an accelerator opening signal and for carrying out a control operation of a routine on the basis of a predetermined signal such as the engine crank angle signal or a signal generated at fixed intervals in accordance with a predetermined program during a period of time between the predetermined signals; and a means for limiting or counting the number of times interrupt processing triggered by an activation signal for the routine is executed during the period of time between the predetermined signals on condition that processing of the routine exists, wherein at least a means for limiting or counting the number of times is provided for a fuel injection setting routine.

It is desirable to provide an engine control device wherein the fuel injection setting routine comprises a uniform mixture charge combustion setting sub-routine and a stratified charge combustion setting sub-routine.

It is further desirable to provide an engine control device wherein a time duration of control execution triggered by an interrupt is measured by using a timer and, as a value of the time duration equal to or greater than a threshold value set in advance is detected, limitation is imposed on the number of times.

It is still further desirable to provide an engine control device wherein the number of times control triggered by an interrupt is executed during a predetermined period of time is measured and, as of a value of the number of times equal to or greater than a threshold value set in advance is detected, limitation is imposed on the number of times.

It is yet desirable to provide an engine control device wherein, for interrupt control executed on the basis of clock changes of CPUs, the clock changes are compared with each other and, only if a set state is detected, the control is executed.

By taking the countermeasures described above, no deterioration of the operability and the gas exhaust performance is expected even if the engine speed increases in the course of processing. Based on this fact, the present invention also provides a recording medium of an engine control device for storing a predetermined program to be executed by a microcomputer for: carrying out processing based on a variety of operating state detection signals such as an engine crank angle signal; carrying out a control operation in accordance with a predetermined program during a period of time between the engine crank angle signals; and limiting the number of times interrupt processing triggered by an activation signal for the routine is executed during the period of time between the engine crank angle signals on condition that at least processing of the routine exists.

The technological scope of the present invention is not limited to what is claimed in this specification: Instead, the scope also includes engine control devices and recording media that can be derived with ease from what is claimed.

BRIEF DESCRIPTION OF THE DRAWINGS

An embodiment of the present invention will be described with reference to the following diagrams wherein.

DETAILED DESCRIPTION OF THE PREFERRED EMBODIMENTS

The present invention will become more apparent from a careful study of the following detailed description of some preferred embodiments with reference to the accompanying diagrams.

Figure 1:
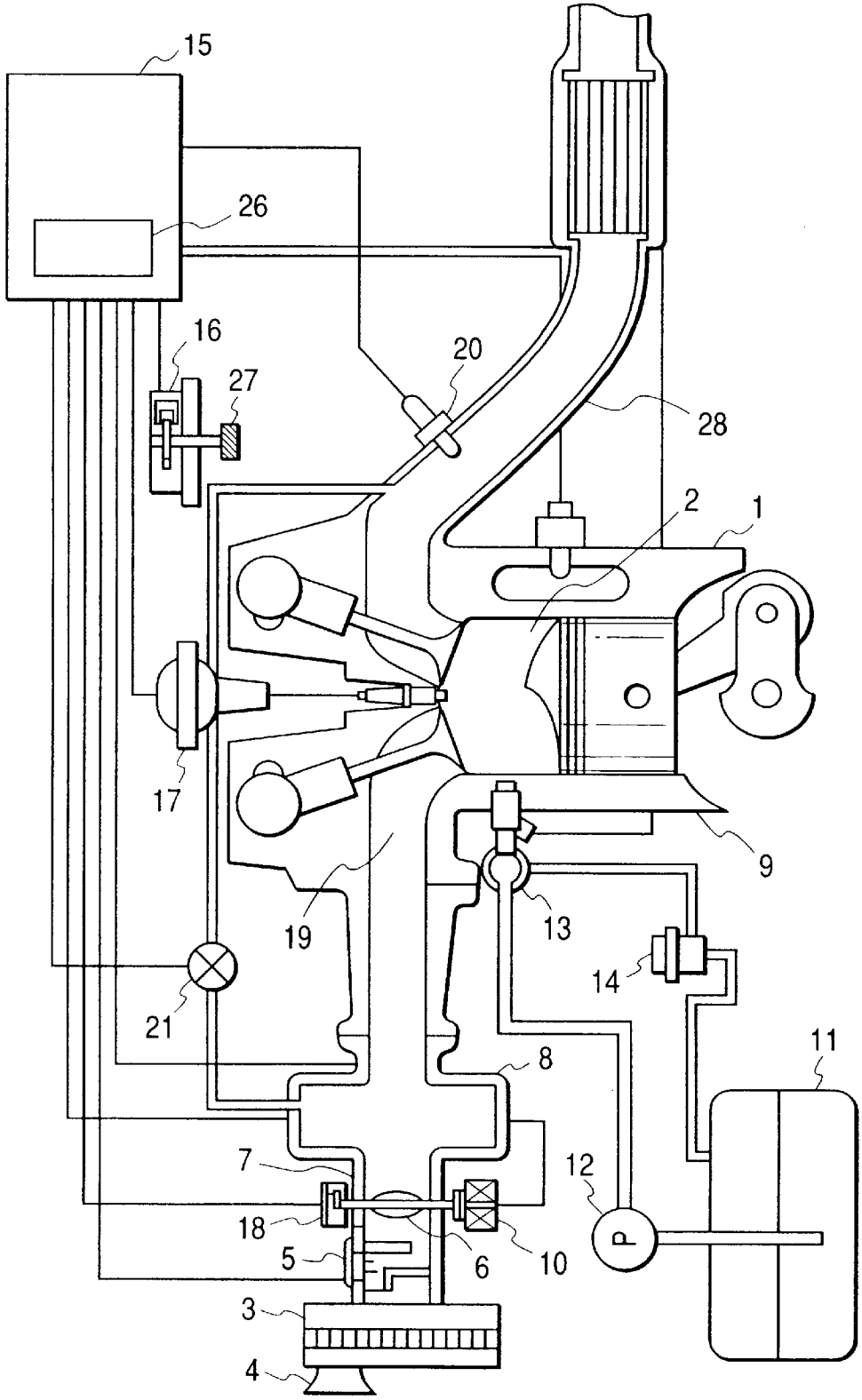
FIG. 1 is a diagram showing an example of an engine system to which the present invention is applied.

FIG. 1 is a diagram showing an example of an engine system to which the present invention is applied. As shown in the figure, air to be supplied to an engine 1 is input from an entrance 4 of an air cleaner 3 and is led to a collector 8 by way of a throttle valve body 7 which is provided with a throttle valve 6 for controlling the intake air volume. Connected to a motor 10, the throttle valve 6 is operated by driving the motor 10 to control the intake air volume. The intake air reaching the collector 8 is distributed among intake pipes 19 each connected to one of cylinders 2 of the engine 1 and supplied to the cylinders 2.

On the other hand, fuel such as gasoline is sucked from a fuel tank 11 by a pump 12 and compressed before being supplied to a fuel system which includes a fuel injection valve 13 and a combustion pressure regulator 14. To put it in detail, the pressure of the fuel is adjusted by the combustion pressure regulator 14 to a predetermined value. The fuel is then injected to the cylinders 2 from the fuel injection valve 13 which has a fuel injection opening opened to face each of the cylinders 2. In the mean time, an airflow meter 5 outputs a signal representing the intake air volume to a control unit 15.

The throttle valve body 7 is provided with a throttle sensor 18 for detecting the degree of opening of the throttle valve 6. A signal output by the throttle sensor 18 is also supplied to the control unit 15.

Reference numeral 16 is a crank angle sensor. Rotated by a cam shaft 27, the crank angle sensor 16 outputs a signal representing a rotational position of a crank shaft to the control unit 15.

Reference numeral 20 is an A/F sensor provided on an exhaust pipe 28. The A/F sensor 20 is used for detecting an actual operating air-fuel ratio from components of exhausted gas and outputting a signal representing the air-fuel ratio to the control unit 15.

The control unit 15 includes a processing means 26 for receiving signals as input signals from sources such as a variety of sensors for detecting the operating state of the engine represented by signals such as the crank angle signal and an acceleration opening signal generated by the sensors. The processing means 26 carries out predetermined processing on the input signals and outputs a variety of calculated control signals as results of the processing. In particular, the processing means 26 outputs predetermined control signals to the fuel injection valve 13, an ignition coil 17 and the motor 10 for operating the throttle valve 6 in order to execute fuel supply control, ignition timing control and intake air volume control.

Figure 2:
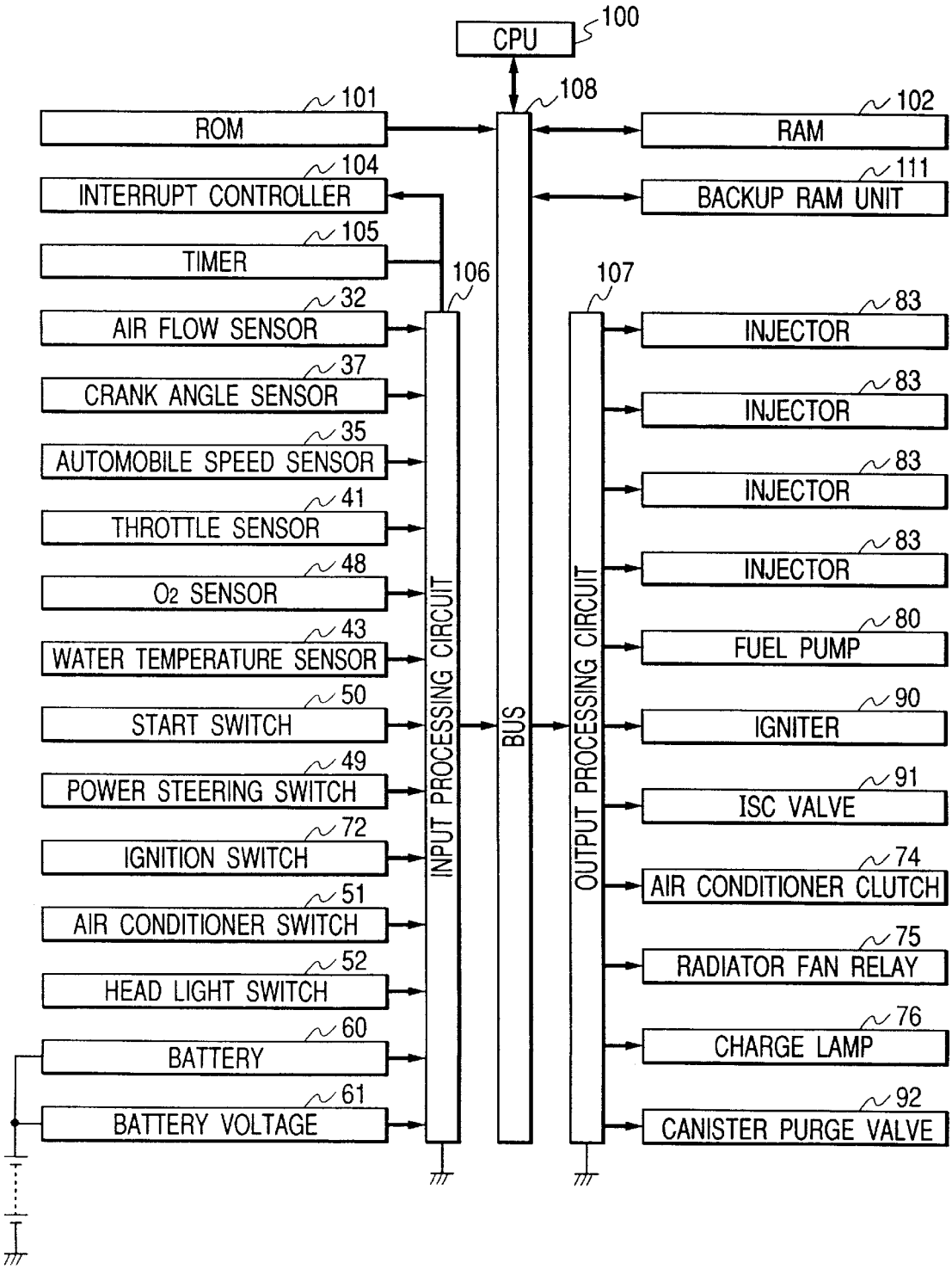
FIG. 2 is a block diagram showing a control unit employed in an engine control device provided by the present invention.

FIG. 2 is a block diagram showing the control unit 15. As shown in the figure, the control unit 15 comprises a CPU 100 serving as the processing means 26, a ROM (Read Only Memory) unit 101, a RAM (Random Access Memory) unit 102 allowing data to be read out from or written into, a backup RAM unit 111 which is capable of retaining the contents thereof even if the ignition key is turned off, an interrupt controller 104, a timer 105, an input processing circuit 106, an output processing circuit 107 and a bus 108 for connecting these components composing the control unit 105 to each other. The CPU 100 executes a program stored in the ROM unit 101 to carry out processing on various kinds of information processed by the input processing circuit 106 by using the RAM unit 102 and the backup RAM unit 111 which is capable of retaining data stored therein even if the ignition key 72 is turned off as described above. In the course of this processing, interrupt processing is also carried out at proper times in accordance with interrupt instructions which are issued by the interrupt controller 104 on the basis of information coming from the timer 105 and the input processing circuit 106.

The input processing circuit 106 receives signals from sensors and switches including an air flow sensor 32, a crank angle sensor 37, an automobile speed sensor 35, a throttle sensor 41, an $O_2$ sensor 48, a water temperature sensor 43, a starter switch 50, a power steering switch 49, an ignition switch 72, an air conditioner switch 51, a head light switch 52, a battery 60 and a battery voltage sensor 61.

On the other hand, the output processing circuit 107 carries out processing to execute various kinds of control and outputs control signals as results of the processing to an injector 83, a fuel pump 80, an igniter 90, an ISC valve 91, an air conditioner clutch 74, a radiator fan relay 75, a charge lamp 76 and a canister purge valve 92.

Figure 3:
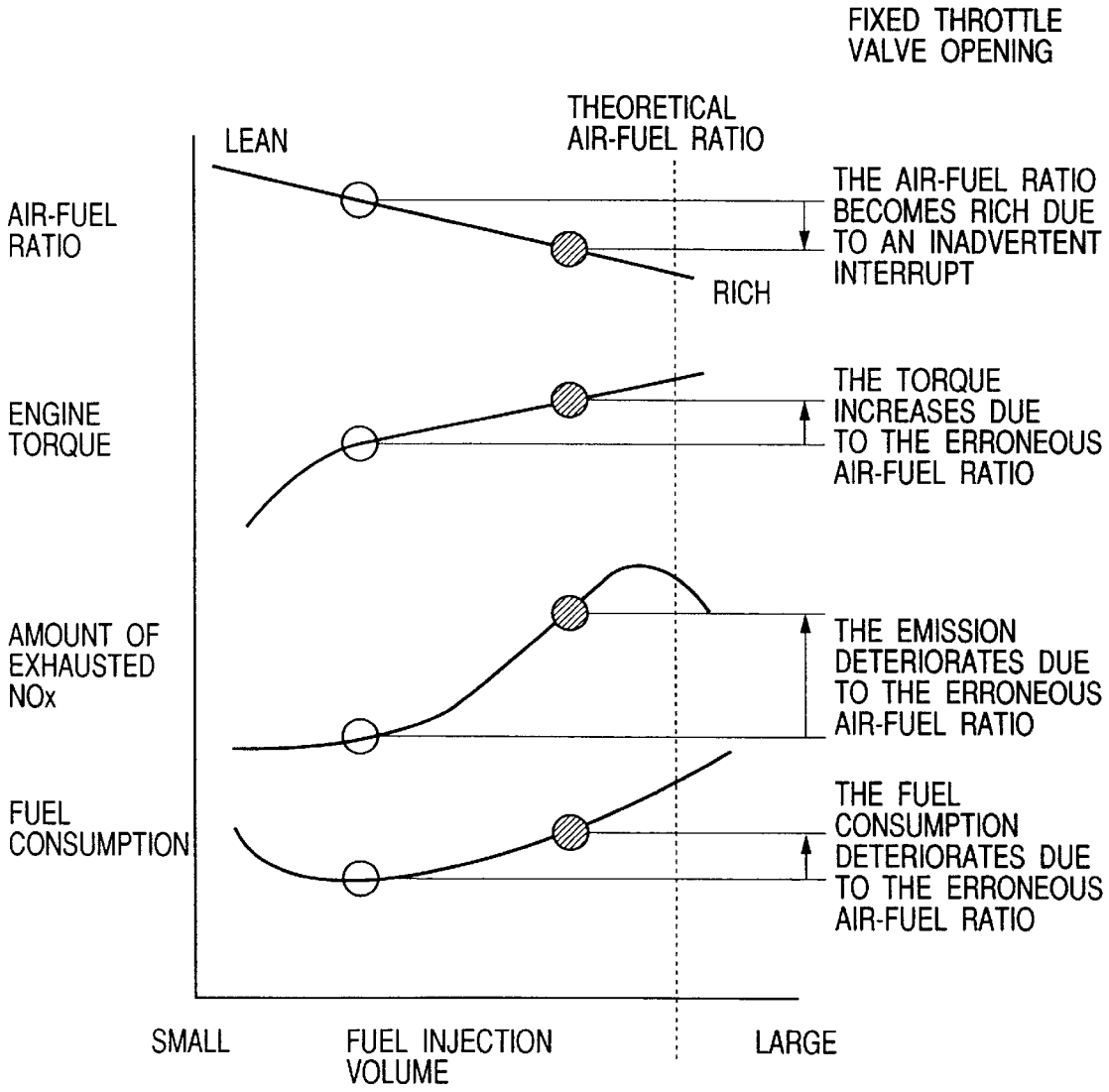
FIG. 3 shows characteristics of an engine.

FIG. 3 shows curves representing characteristics which represent behaviors observed in execution of control of an engine with a fixed throttle opening for small and large fuel injection volumes.

An X axis of the characteristics represents the fuel injection volume which is divided into regions of small and large fuel injection volumes. On the other hand, a Y axis represents the air-fuel ratio, the engine torque, the amount of exhausted $NO_x$ and the fuel consumption. A dotted line is a line representing a theoretical air-fuel ratio. In the case of a fixed throttle opening, the air-fuel ratio changes from a lean value to a rich one due to inadvertent interrupts as shown by the curve at the top in the figure. The erroneous change in air-fuel ratio in turn causes an increase in engine torque. The erroneous change in air-fuel ratio also increases the amount of exhausted $NO_x$ as well, contributing to deterioration of emission. The fuel consumption is worsened by an increase in amount of consumed fuel which is caused by the erroneous change in air-fuel ratio as is obvious from the bottom curve.

Figure 4:
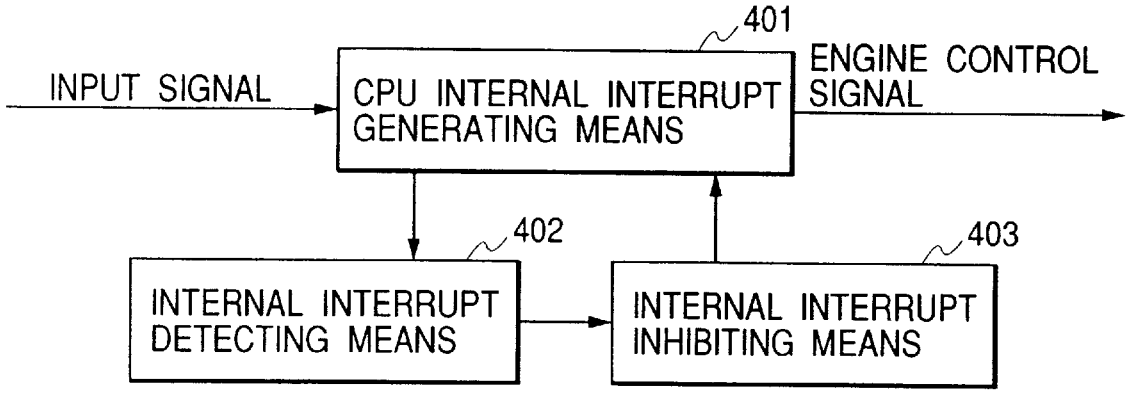
FIG. 4 is a functional block diagram showing an embodiment implementing an engine control device provided by the present invention.

FIG. 4 is a functional block diagram showing an embodiment implementing an engine control device provided by the present invention.

An interrupt for triggering interrupt processing to be carried out by the CPU 100 is generated in a CPU internal interrupt generating means 401 with timing of an input signal such as a crank angle signal supplied to the CPU 100. An internal interrupt detecting means 402 counts the number of times the internal interrupt is generated in the CPU internal interrupt generating means 401 or detects the driving time of an actuator controlled by the interrupt. If the number of times the internal interrupt is generated in the CPU internal interrupt generating means 401 or the driving time of an actuator controlled by the interrupt exceeds a predetermined value, an internal interrupt inhibiting means 403 imposes a limitation on the execution of the interrupt processing. The CPU internal interrupt generating means 401 then carries out processing to execute control of the engine and finally outputs engine control signals. The CPU internal interrupt generating means 401, the internal interrupt detecting means 402 and the internal interrupt inhibiting means 403 are implemented by a microcomputer which carries out processing represented by flowcharts to be described as follows.

Next, an embodiment of the present invention is explained by referring to the flowcharts and diagrams.

Figure 6:
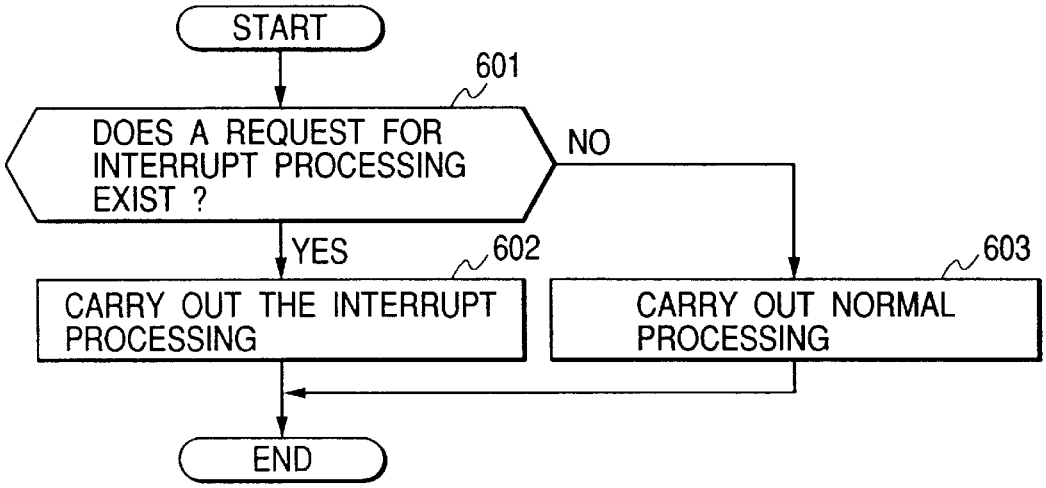
FIG. 6 shows a general flowchart representing conventional control based on internal interrupts.

FIG. 6 shows a general flowchart representing conventional control based on internal interrupts. As shown in the figure, the flowchart begins with a block 601 to form a judgment as to whether or not a request for interrupt processing exists. If such a request exists, the flow of control goes on to a block 602 in which interrupt processing is carried out in accordance with a processing priority order set in advance. If such a request does not exist, on the other hand, the flow of control proceeds to a block 603 in which normal processing is carried out.

Figure 7:
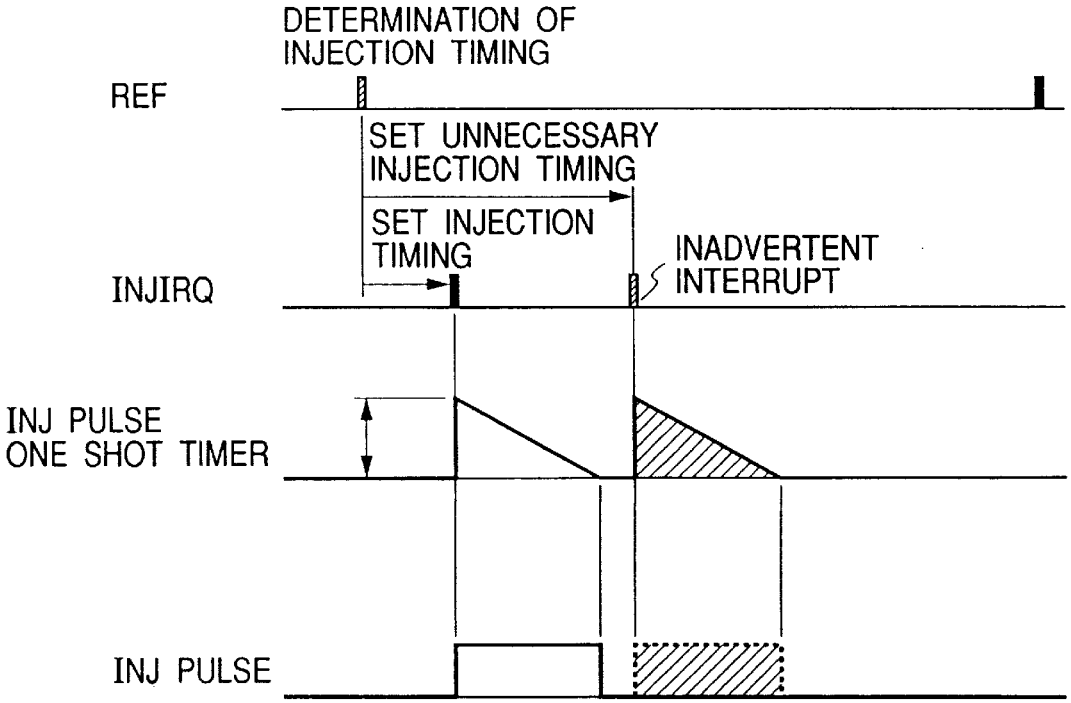
FIG. 7 is a typical timing diagram used for explaining an example of execution of the conventional control.

FIG. 7 is a typical timing diagram used for explaining an example of execution of control for setting fuel injection by a CPU internal interrupt detected by processing represented by the flowchart shown in FIG. 6.

When an inadvertent interrupt is generated internally due to a control software bug or the like, unnecessary fuel injection is set inadvertently, causing fuel to be injected more times than needed. As a result, the fuel injection volume increases and the air-fuel ratio becomes excessively richer than a desired value.

In the event of a phenomenon of inadvertently setting fuel injection shown in FIG. 7, the air-fuel ratio becomes excessively richer than a desired value as shown in FIG. 3. In this case, the engine torque increases, adversely affecting operability. In addition, the amount of exhausted emission gas ($NO_x$) also increases and, further, the fuel consumption deteriorates as well.

Figure 5:
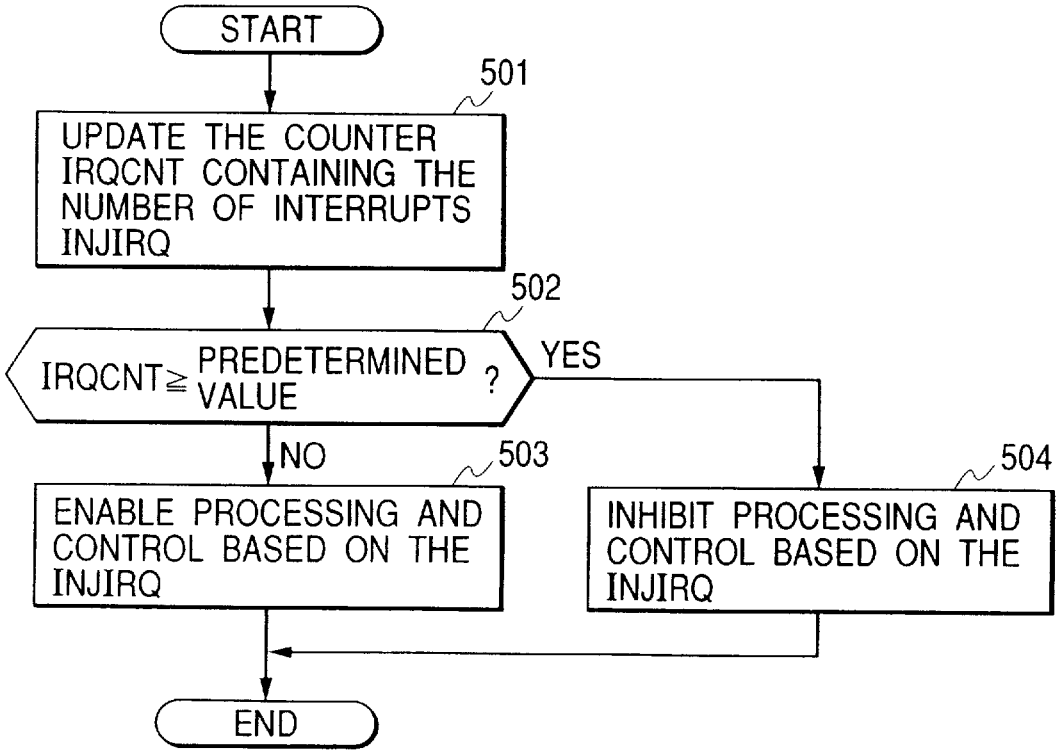
FIG. 5 shows a general flowchart representing an example of control to handle an inadvertent interrupt.

FIG. 5 shows a general flowchart representing an example of control to handle an inadvertent interrupt detected by the processing represented by the flowchart shown in FIG. 7. To be more specific, the processing shown in FIG. 5 represents details of the block 602 of the flowchart shown in FIG. 6. As shown in FIG. 5, the flowchart begins with a block 501 in which the number (IRQCNT) of requests (INJIRQ) for implementation of fuel injection is updated. The flow of control then goes on to a block 502 to form a judgment as to whether or not the number of requests (IRQCNT) is greater than a predetermined value to represent the number of interrupts that are generated at normal times. If the number of requests (IRQCNT) is equal to or smaller than the predetermined value, the flow of control goes to a block 503 in which interrupt control is executed. If the number of requests (IRQCNT) is greater than the predetermined value, on the other hand, the flow of control proceeds to a block 504 to inhibit execution of control triggered by an interrupt which occurs after number of requests (IRQCNT) has become equal to the predetermined value.

Figure 8:
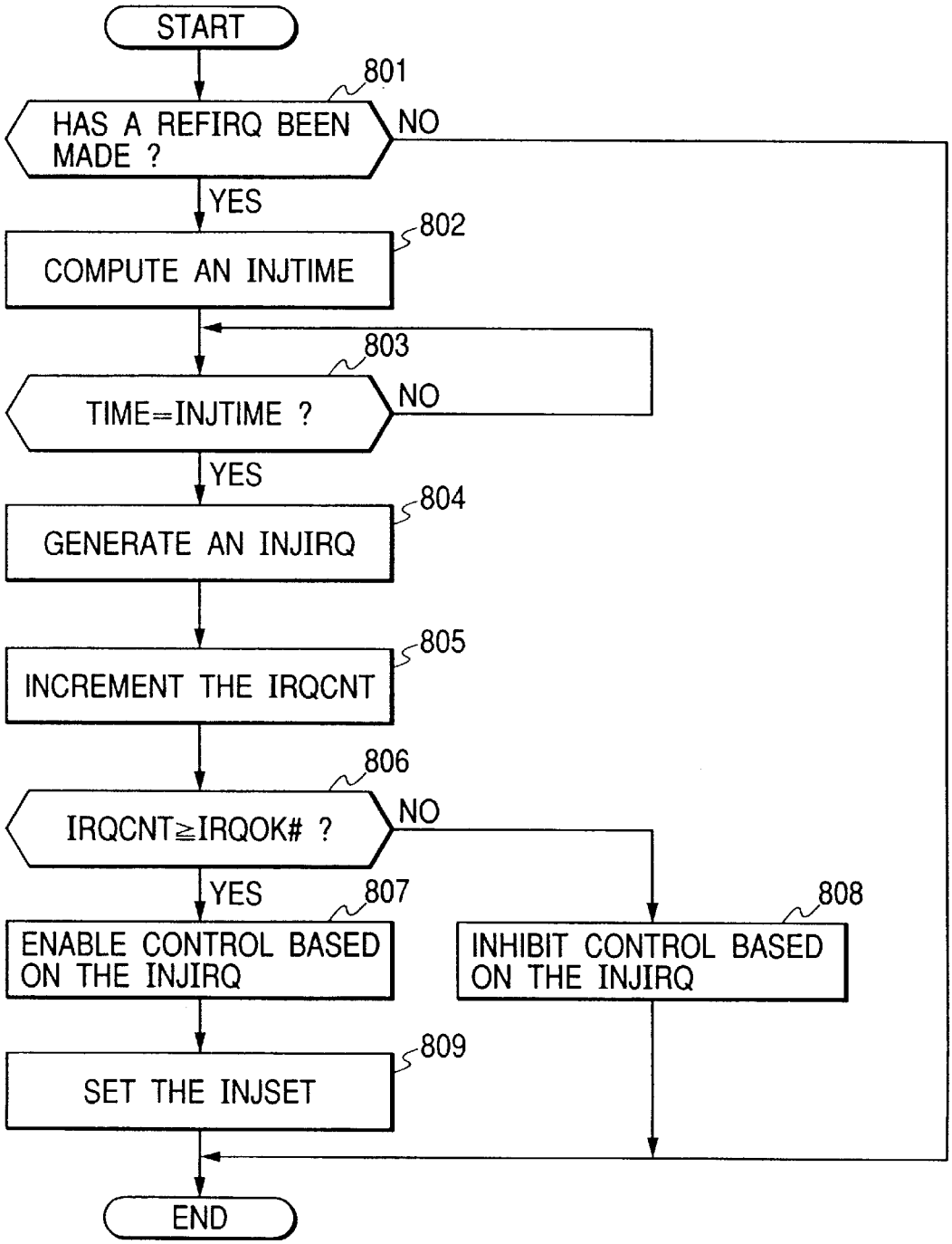
FIG. 8 shows a general flowchart representing control to handle an inadvertent interrupt.

FIG. 8 shows a general flowchart representing control to set fuel injection as requested by a crank angle signal. The flowchart also includes processing to handle an inadvertent interrupt which may occur after the generation of the crank angle signal as is the case with the processing represented by the flowchart shown in FIG. 5. As shown in the figure, the flowchart begins with a block 801 to form a judgment as to whether or not a crank angle signal (REFIQR) has been generated. The crank angle signal is used as a reference signal for setting fuel injection. If a crank angle signal has been generated, the flow of control goes on to a block 802 in which fuel injection timing (INJTIME) is determined. The flow of control then proceeds to a block 803 to form a judgment as to whether or not the engine crank angle has reached a value corresponding to the fuel injection timing (INJTIME) determined in the block 802. If the engine crank angle has reached a value corresponding to the fuel injection timing determined in the block 802, the flow of control continues to a block 804 in which a CPU internal interrupt is generated for making a request (INJIRQ) for implementation of the fuel injection. The flow of control then goes on to a block 805 in which the number (IRQCNT) of requests (INJIRQ) for implementation of fuel injection is incremented. The flow of control then goes on to a block 806 to form a judgment as to whether or not the number of requests (IRQCNT) is greater than a predetermined value (IRQOK) to represent the number of interrupts that are generated at normal times. If the number of requests (IRQCNT) is equal to or smaller than the predetermined value, the flow of control goes to a block 807 in which interrupt control is executed. The flow of control then goes on to a block 809 in which fuel injection control is executed. If the number of requests (IRQCNT) is greater than the predetermined value, on the other hand, the flow of control proceeds to a block 808 to inhibit execution of control triggered by an interrupt which occurs after number of requests (IRQCNT) has become equal to the predetermined value. By executing the processing in accordance with the flow described above, the engine can be protected against problems caused by inadvertent interrupts.

Figure 9:
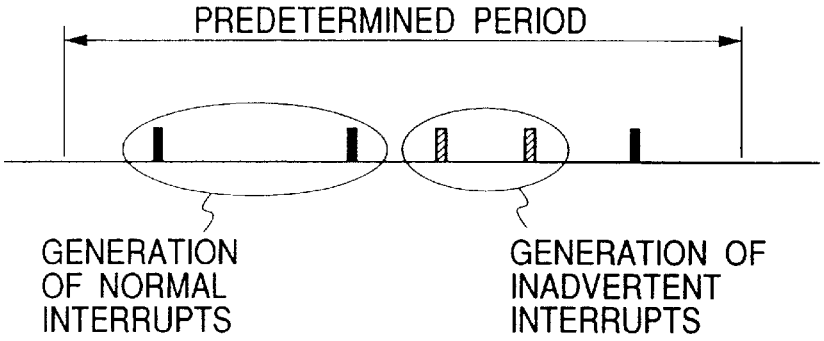
FIG. 9 shows a time chart used for explaining execution of control of interrupts which are normally generated at predetermined intervals.

FIG. 9 shows a time chart used for explaining execution of control of interrupts which are normally generated at predetermined intervals. The timing chart obviously indicates that inadvertent interrupts increase the number of interrupts generated during a predetermined period of time.

Figure 10:
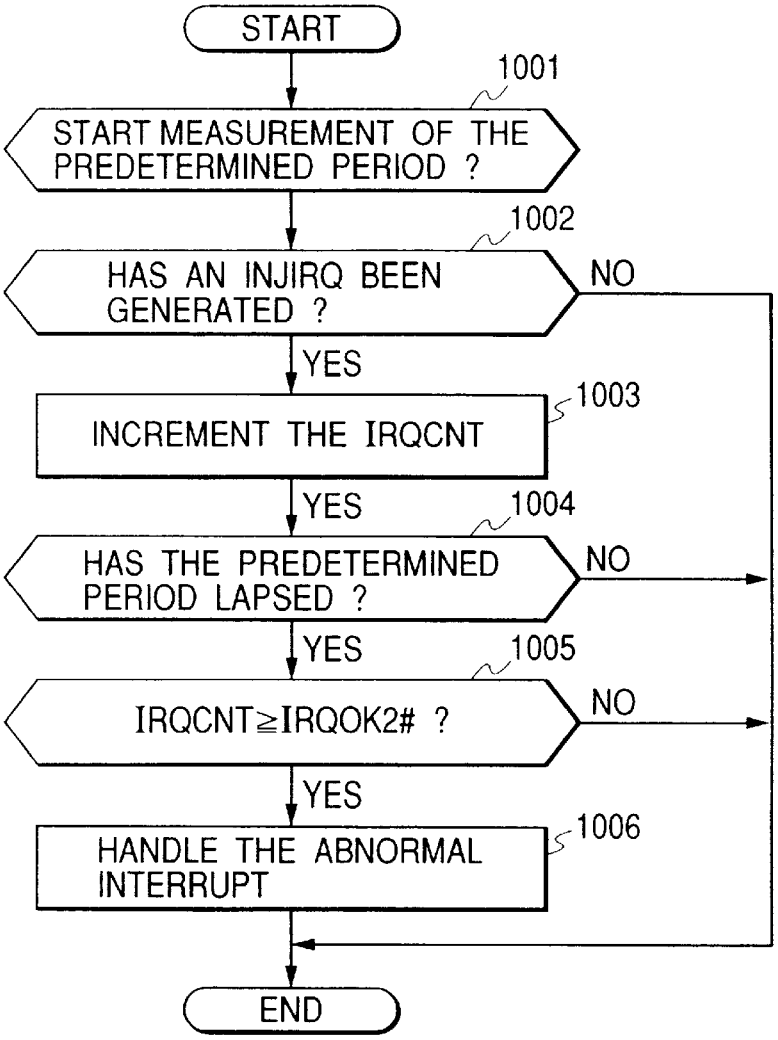
FIG. 10 shows a general flowchart representing control in which the number of interrupts generated during a predetermined period of time shown in FIG. 9 is taken into consideration.

FIG. 10 shows a general flowchart representing control in which the number of interrupts generated during a predetermined period of time shown in FIG. 9 is taken into consideration. As shown in the figure, the flowchart begins with a block 1001 to start the measurement of the predetermined period of time during which the number of interrupts is counted. The flow of control then goes on to a block 1002 to form a judgment as to whether or not an interrupt has been generated since the start of the measurement of the predetermined period of time. If an interrupt has been generated, the flow of control goes on to a block 1003 in which the number of generated interrupts is incremented. The flow of control then proceeds to a block 1004 to form a judgment as to whether or not the predetermined period of time, the measurement of which was started in the block 1001, has lapsed. If the outcome of the judgment formed in the block 1004 indicates that the predetermined period of time has lapsed, the number of generated interrupts incremented in the block 1003 indicates the final number of interrupts generated in the predetermined period of time. In this case, the flow of control continues to a block 1005 to form a judgment as to whether or not the number of interrupts is greater than a predetermined value to represent the number of interrupts that are generated at normal times. If the number of interrupts is greater than the predetermined value, the flow of control proceeds to a block 1006 in which processing to handle an inadvertent interrupt is carried out. As described above, the processing to handle an inadvertent interrupt is typically to inhibit execution of the inadvertent interrupt, to turn on an alarm lamp for warning the driver of an engine control abnormality or to prevent fuel injection control from being executed during an abnormality judgment transition.

Figure 11:
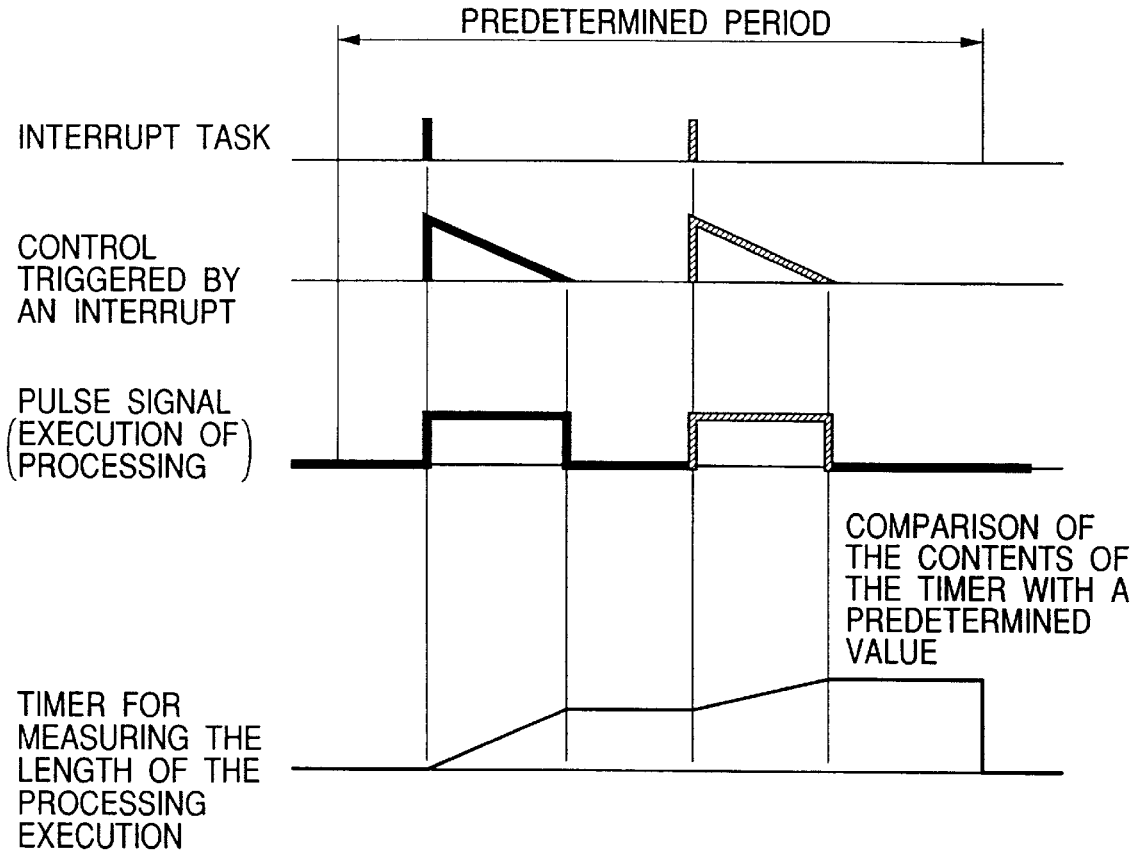
FIG. 11 shows time charts of control whereby the length of a time actually required to execute fuel injections triggered by each interrupt is measured.

FIG. 11 shows time charts of control whereby the length of a time actually required to execute fuel injection triggered by each interrupt generated within a predetermined period of time is measured by using a timer set separately. In the execution of control based on an interrupt to set a fuel injection volume, the length of an actual ON time of an injector in a period of time between crank angle signals is measured and compared with a result of fuel injection pulse width processing, allowing an increase in fuel injection volume caused by an inadvertent interrupt to be detected.

Figure 12:
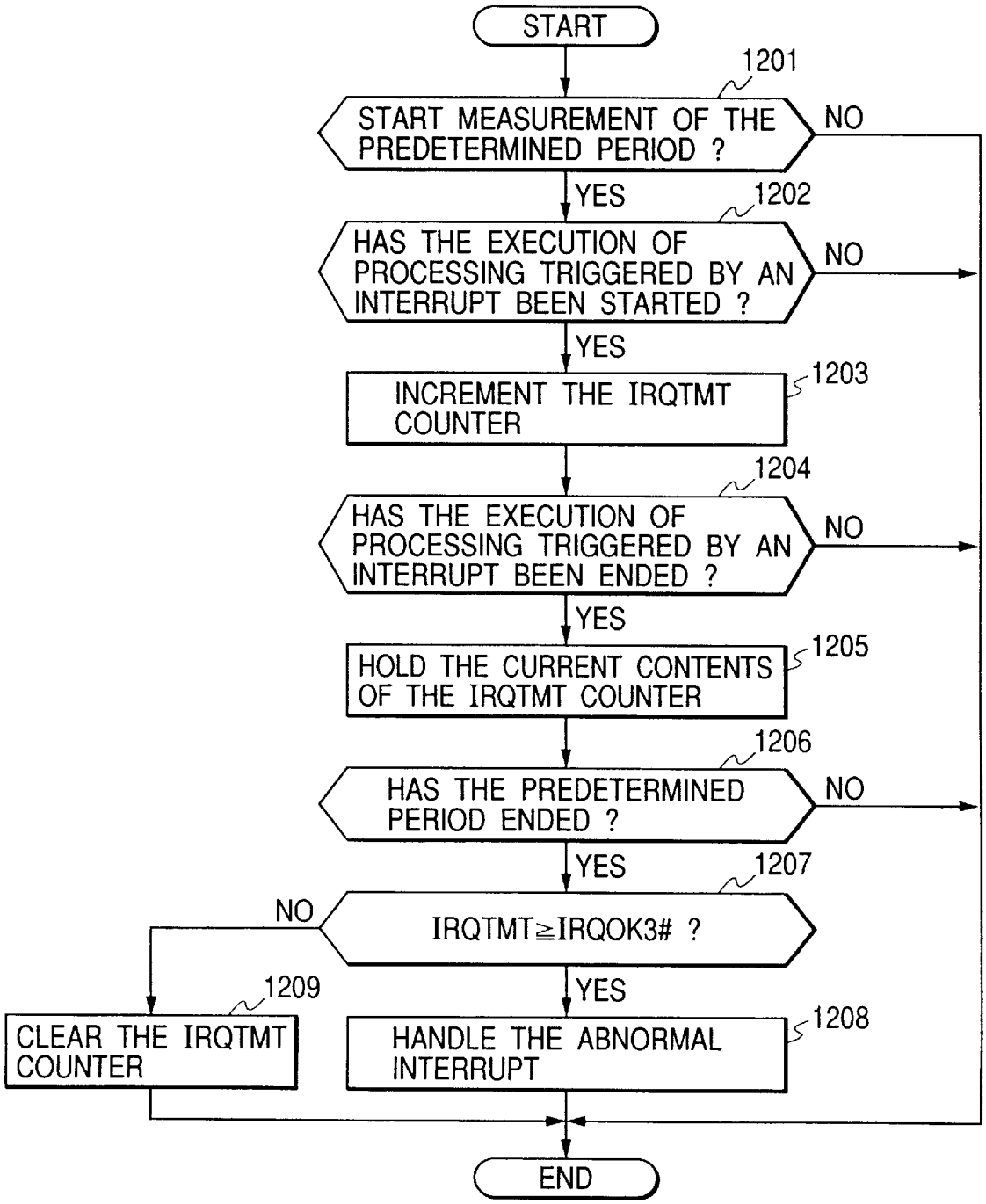
FIG. 12 shows a general flowchart representing control to handle an inadvertent interrupt by direct measurement of the length of a time actually required to execute control of fuel injection shown in FIG. 11.

FIG. 12 shows a general flowchart representing control to handle an inadvertent interrupt by direct measurement of the length of a time required to execute control of each fuel injection shown in FIG. 11. As shown in the figure, the flowchart begins with a block 1201 in which the measurement of a predetermined period of time is started typically by a signal output by the crank angle sensor. The flow of control then goes on to a block 1202 to form a judgment as to whether or not an interrupt has been generated during the period of time currently being measured. If an interrupt has been generated, interrupt control is executed. In this case, the flow of control proceeds to a block 1203 in which the state of an actuator being controlled by the interrupt control triggered by the generated interrupt is measured directly by a timer in order to measure the length of a time actually required to execute the interrupt control. Then, the flow of processing continues to a block 1204 to form a judgment as to whether or not the execution of the control triggered by the generated interrupt has been completed, that is, whether or not the injector ON control has been completed as evidenced by an injector output terminal having changed from a high level to a low level. If the execution of the control triggered by the generated interrupt has been completed, the flow of control goes on to a block 1205 in which the operation of the timer is halted to hold the contents of the timer as they are. The timer is then ready for measuring the length of a time actually required to execute control triggered by a next interrupt generated in the predetermined period currently being measured. The flow of control then proceeds to a block 1206 to form a judgment as to whether or not the predetermined period of time, the measurement of which was started in the block 1201, has lapsed. Interrupts generated during the predetermined period of time each trigger control, the execution time of which is measured by the timer in the block 1203. If the predetermined period of time has not lapsed yet, the flow of control returns to the block 1201 to repeat the pieces of processing in the blocks 1201 to 1206, incrementing the contents of the timer IRQTMT till the predetermined period period of time lapses. If the predetermined of time has lapsed, on the other hand, the flow of control continues to a block 1207 to form a judgment as to whether or not the contents of the timer representing the total length of times required to execute the pieces of control triggered by the interrupts are equal to or greater than a predetermined value to represent the total length of times required to execute pieces of control triggered by interrupts generated at normal times. If the contents of the timer are equal to or greater than the predetermined value, the flow of control proceeds to a block 1208 in which processing to handle an abnormal or inadvertent interrupt is carried out. As described above, the processing of an inadvertent interrupt is typically to inhibit execution of the inadvertent interrupt, to turn on an alarm lamp for warning the driver of an engine control abnormality or to prevent fuel injection control from being executed during an abnormality judgment transition. After correcting an error generated in the execution of the processing of the inadvertent interrupt, if any, the flow of control proceeds to a block 1209 in which whether control execution error caused by the unnecessary interrupt occurs is detected. When the detection is completed, the contents of the timer are cleared to prepare for the next judgement.

Figure 13:
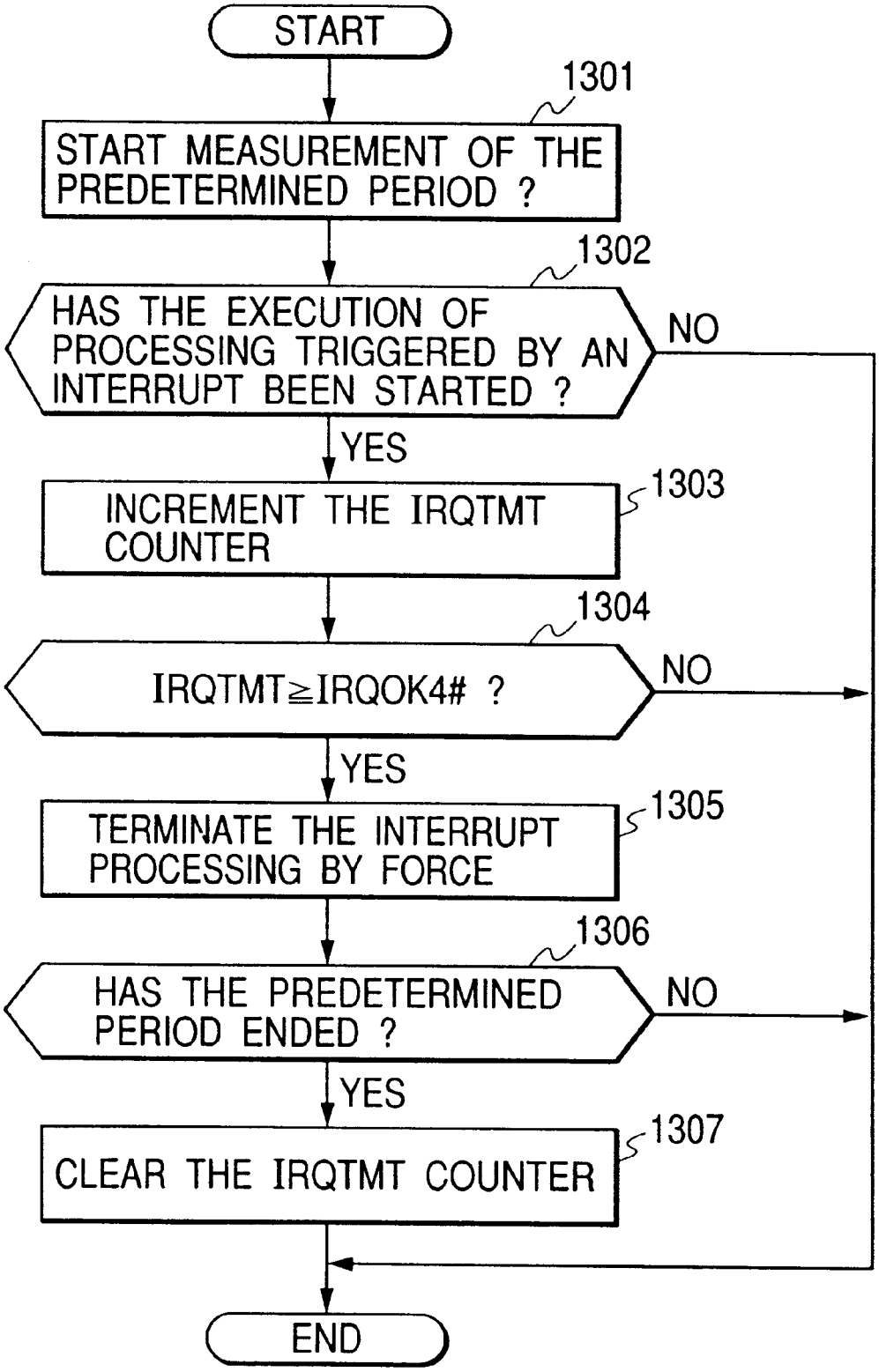
FIG. 13 shows a general flowchart representing control to handle an inadvertent interrupt caused by an abnormality in measurement of the length of a time actually required to execute of control of fuel injection.

FIG. 13 shows a general flowchart representing control to handle an inadvertent interrupt by direct measurement of the length of a time required to execute control of a fuel injection. The flowchart shown in FIG. 13 is similar to that of FIG. 12 in that the length of a time is measured by measuring the period of time during which an actuator driving terminal is set at a high level. In the case of the control shown in FIG. 13, however, when the contents of the timer resulting from the measurement are judged to be abnormal, special processing is carried out to cope with the abnormality.

More specifically, in a block 1304, the contents of the timer representing the total length of times required to execute pieces of control triggered by interrupts are compared with a predetermined value to represent the total length of times required to execute pieces of control triggered by interrupts triggered by interrupts generated at normal times. If the contents of the timer representing the total length of times required to execute pieces of control triggered by interrupts are found equal to or greater than the predetermined value, the flow of control goes on to a block 1305 in which the control is terminated forcibly, that is, the actuator is turned off. The flow of control then proceeds to a block 1306 to form a judgment as to whether or not the predetermined period of time, the measurement of which was started in the block 1301, has lapsed in order to get ready for a diagnosis in the next period of time. After verifying that the predetermined period of time has lapsed, the flow of control continues to a block 1307 in which the contents of the timer IRQTMT are cleared.

Figure 14:
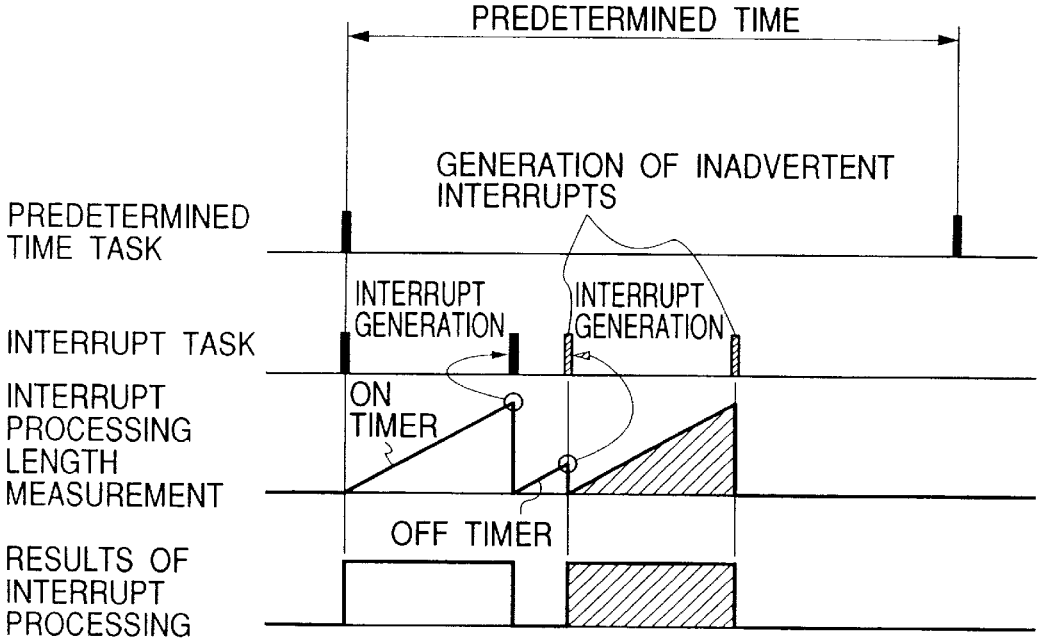
FIG. 14 is a timing diagram used for explaining control actions to drive an actuator.

FIG. 14 is a timing diagram used for explaining control actions to drive an actuator based on CPU timers. An ON timer of the output compare type is used for measuring the duty to drive the actuator. The duty is normally activated at predetermined intervals of typically 10 ms. As the contents of the ON timer exceed a predetermined value, that is, as a predetermined ON time measured by the ON timer lapses, a duty OFF timer is activated by an internal interrupt for measuring the OFF time. If an inadvertent interrupt is generated, the duty is again activated to drive the actuator as shown in the figure. If the control technique shown in FIG. 14 is applied to control of a duty to drive a canister purge valve, for example, the canister purge valve will be activated for a period of time longer than required. As a result, the accuracy of the control of the air-fuel ratio deteriorates, having adversely affected operability and the gas exhaust performance.

Figure 15:
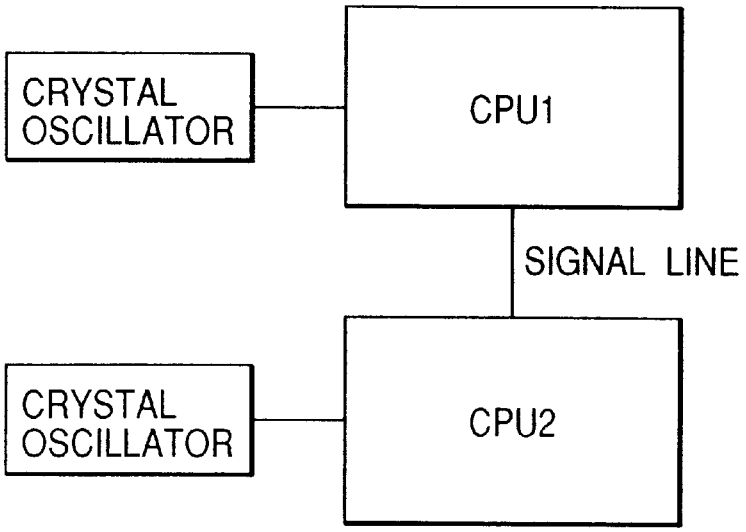
FIG. 15 is a diagram showing CPU timers.
Figure 16:
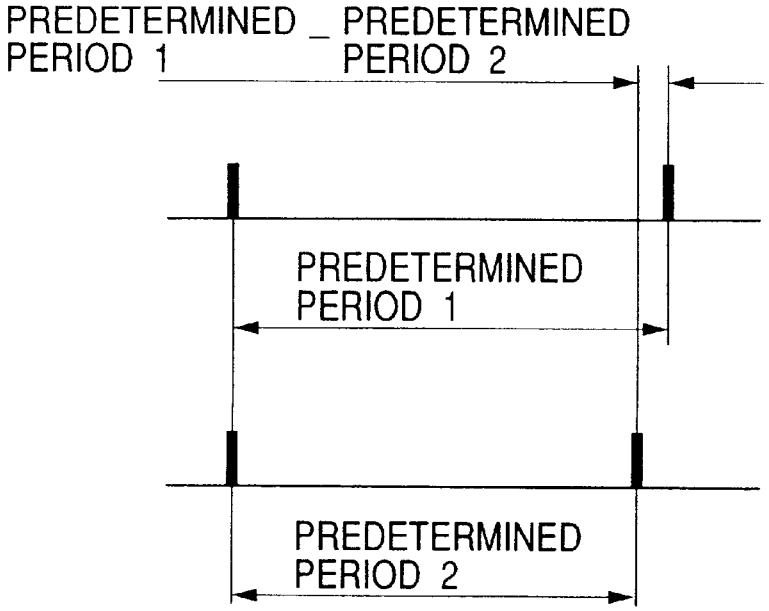
FIG. 16 is a diagram showing comparison of predetermined periods of time.

An inadvertent interrupt is generated by a timer abnormality in the CPU. In order to solve this problem, the timer is designed into a configuration based on pulses (a clock signal) generated by a crystal oscillator connected to the CPU as shown in FIG. 15. As a technique of detecting an abnormality of the timer in the CPU and the clock signal, two CPUs are embedded in the control unit. In the case two CPUs are connected to different crystal oscillators as shown in FIG. 15, predetermined periods of time measured by the two CPUs are compared with each other as shown in FIG. 16 to form a judgment as to whether or not an abnormality is generated. To put it in detail, the lapses of the predetermined period of time are compared with each other with their starts synchronized. If the timer of either CPU generates an abnormality, the difference between the predetermined periods of time increases, exceeding a predetermined value as follows:

Time Difference (=Predetermined Period of Time 1−Predetermined Period of Time 2)>Predetermined Value.

Figure 17:
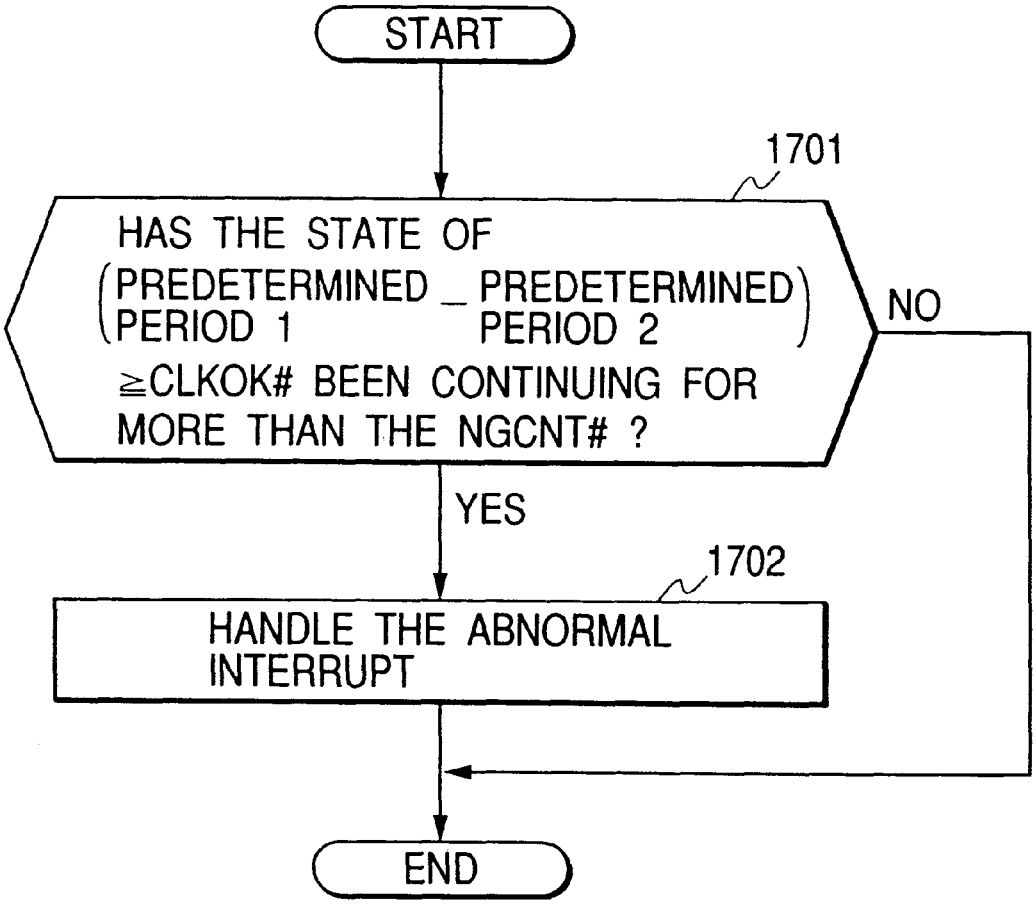
FIG. 17 shows a general flowchart representing control to diagnose timers for an abnormality as shown in FIG. 16.

FIG. 17 shows a general flowchart representing control for diagnosing timers for an abnormality as shown in FIG. 16. As shown in FIG. 17, the flowchart begins with a block 1701 in which, after the two CPUs mutually synchronize the start points of measurement of the predetermined periods of time with each other, a time difference (=Predetermined Period of Time 1−Predetermined Period of Time 2) resulting from the same time measurement between the predetermined periods of time is compared with a predetermined value at a normal time in order to form a judgment as to whether or not an abnormality has been generated. The start points of the measurement can be synchronized to each other by connecting pins of the CPUs by a harness and activating the timers at a change in level occurring at the pins, that is, typically at a transition of a signal appearing at the pins from a high level to a low level or vice versa.

If the time difference is equal to or smaller than the predetermined value, normal processing is carried out. If the time difference is greater than the predetermined value, on the other hand, the flow of control goes on to a block 1702 in which processing to handle an abnormal interrupt is carried out. As described above, the processing to handle an abnormal interrupt is typically the one to inhibit execution of the inadvertent interrupt, to turn on an alarm lamp for warning the driver of an engine control abnormality or to prevent fuel injection control from being executed during an abnormality judgment transition.

The control unit 15 carries out processing based on a variety of operating states represented by the engine crank angle signal and the acceleration opening. In addition, the control unit 15 carries out a control operation of a routine during a period of time between engine crank angle signals in accordance with a predetermined program. The control unit 15 is controlled by a recording medium for storing a program. To put it in detail, the program stored in the recording medium limits the number of times an interrupt triggered by another activation signal for the same routine during a period of time between the engine crank angle signals can be processed on condition that at least the processing of the routine exists.

According to the present invention, a control unit 15 carries out a control operation of a routine existing during a period of time between engine crank angle signals or predetermined signals such as periodical signals and there is provided a means for counting or limiting the number of times an interrupt triggered by another activation signal for the same routine during the period of time between the predetermined signals is handled on condition that at least processing of the routine taken exists. As a result, it is possible to monitor or avoid an inadvertent interrupt generated by noise or a software bug.

Thus, since unnecessary processing accompanying such an inadvertent interrupt is not carried out, it is possible not only to prevent the operability and the gas exhaust performance from deteriorating, but also to totally cope with an inadvertent interrupt that may have adversely affected operability and the gas exhaust performance. As a result, the reliability of the engine control device can be improved substantially.

What is claimed is:

1. An engine control device comprising:

a processing means for receiving operating state detection signals including at least one of an engine crank angle signal and an accelerator opening signal, and for computing control quantities for a routine on the basis of a predetermined signal which is one of an engine crank angle signal and a signal generated at fixed basic intervals, in accordance with a predetermined program during a period of time between predetermined signals; and a means for limiting or counting a number of times interrupt processing triggered by a signal for activating said routine is executed during said period of time between said predetermined signals whenever processing of said routine exists.

2. An engine control device comprising:

a processing means for receiving operating state detection signals including at least one of an engine crank angle signal and an accelerator opening signal, and for determining fuel injection timing on the basis of said engine crank angle signal in accordance with a predetermined program during a period of time between engine crank angle signals; and a means for limiting to zero a number of times interrupt processing triggered by an activation signal for fuel injection timing is executed during said period of time between said predetermined crank angle signals whenever at least processing to determine said fuel injection timing exists in said period of time between said predetermined crank angle signals.

3. An engine control device wherein:

operating state detection signals including at least one of an engine crank angle signal and an accelerator opening signal are supplied to a processing means;

a fuel injection operation is determined by said processing means on the basis of said engine crank angle signal in accordance with a predetermined program during a period of time between engine crank angle signals; and a number of times interrupt processing triggered by an activation signal for said fuel injection operation is executed during said period of time between said predetermined crank angle signals in a lean burn operation, is limited or counted whenever at least said fuel injection operation exists in said period of time between said predetermined crank angle signals.

4. An engine control device comprising:

a processing means for receiving operating state detection signals including at least one of an engine crank angle signal and an accelerator opening signal, and for carrying out a control operation of a routine on the basis of a predetermined signal which is one of an engine crank angle signal and a signal generated at fixed intervals, in accordance with a predetermined program during a period of time between predetermined signals; and a means for limiting or counting a number of times interrupt processing triggered by a signal for activating said routine is executed during said period of time between said predetermined signals whenever processing of said routine exists;

wherein at least a means for limiting or counting said number of times is provided for a fuel injection setting routine.

5. An engine control device according to claim 4 wherein said fuel injection setting routine comprises a uniform mixture charge combustion setting sub-routine and a stratified charge combustion setting sub-routine.

6. An engine control device according to claim 4 wherein a time duration of control execution triggered by an interrupt is measured by using a timer and, a value of said time duration that is, equal to or greater than a predetermined threshold value is detected, a limitation is imposed on said number of times.

7. An engine control device according to claim 4 wherein a number of times control triggered by an interrupt is executed during a predetermined period of time is measured and, when a value of said number of times equal to or greater than a predetermined threshold value is detected, a limitation is imposed on said number of times.

8. An engine control device according to claim 4 wherein, for interrupt control executed on the basis of clock changes of CPUs, said clock changes are compared with each other and, said control is executed only if a set state is detected.

9. In an engine control device having a microcomputer, and a memory unit encoded with a program for:

carrying out processing of a routine based on a variety of operating state detection signals including at least one of an engine crank angle signal;

carrying out a control operation in accordance with a predetermined program during a period of time between engine crank angle signals; and limiting a number of times interrupt processing triggered by an activation signal for said routine is executed during said period of time between engine crank angle signals, whenever at least processing of said routine exists.

* * * * *